US009299332B2

(12) United States Patent
Je

(10) Patent No.: US 9,299,332 B2
(45) Date of Patent: Mar. 29, 2016

(54) APPLIANCE HAVING NOISE REDUCTION DEVICE

(71) Applicant: Byoungsoo Je, Seoul (KR)

(72) Inventor: Byoungsoo Je, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 189 days.

(21) Appl. No.: 13/890,395

(22) Filed: May 9, 2013

(65) Prior Publication Data

US 2013/0298585 A1 Nov. 14, 2013

(30) Foreign Application Priority Data

May 10, 2012 (KR) ..... 10-2012-0049610

(51) Int. Cl.

| | |
|---|---|
| ***G10K 1/00*** | (2006.01) |
| ***G10K 11/00*** | (2006.01) |
| ***A47L 9/00*** | (2006.01) |
| ***A47L 15/42*** | (2006.01) |
| ***D06F 37/00*** | (2006.01) |
| ***F24F 13/24*** | (2006.01) |
| ***G10K 11/172*** | (2006.01) |

(52) U.S. Cl.

CPC ..... *G10K 11/002* (2013.01); *A47L 9/0081* (2013.01); *A47L 15/4255* (2013.01); *D06F 37/00* (2013.01); *F24F 13/24* (2013.01); *G10K 11/172* (2013.01); *F24F 2013/245* (2013.01)

(58) Field of Classification Search

CPC .. G10K 11/002; G10K 11/127; A47L 9/0081; A47L 15/4255; F24F 13/24; F24F 13/245

USPC ..... 62/296, 238.7; 312/237, 294, 319; 34/218

See application file for complete search history.

(56) References Cited

U.S. PATENT DOCUMENTS

| | | | | | |
|---|---|---|---|---|---|
| 3,770,560 | A | * | 11/1973 | Elder et al. | 428/138 |
| 4,084,366 | A | * | 4/1978 | Saylor et al. | 52/791.1 |
| 4,316,406 | A | * | 2/1982 | Lind | 454/284 |
| 4,381,470 | A | * | 4/1983 | Leach et al. | 310/327 |
| 4,860,506 | A | * | 8/1989 | Yoshimi et al. | 52/144 |
| 5,044,705 | A | * | 9/1991 | Nelson | 312/228 |
| 5,512,715 | A | * | 4/1996 | Takewa et al. | 181/295 |
| 5,696,361 | A | * | 12/1997 | Chen | 181/224 |
| 5,855,353 | A | * | 1/1999 | Shaffer et al. | 248/638 |

(Continued)

FOREIGN PATENT DOCUMENTS

| | | |
|---|---|---|
| CN | 2893501 | 4/2007 |
| CN | 201622837 U | 11/2010 |

(Continued)

OTHER PUBLICATIONS

Abstract of JP 2000279691A to Wada et al. dated Oct. 10, 2000.*

(Continued)

*Primary Examiner* — Mohammad M Ali

(74) *Attorney, Agent, or Firm* — Ked & Associates, LLP

(57) ABSTRACT

An appliance is provided including a noise reduction device to reduce noise generated within a main body of the appliance. The noise reduction device may include a sound absorbing plate having a plurality of sound absorbing holes and a resonance member, one side of which is open and having a hollow portion, so that noise generated by a drive of the appliance passes through the noise reduction device, in order to efficiently reduce noise in the appliance and achieve an increase of internal capacity, a decrease in weight, and a reduction in manufacturing costs for the appliance.

14 Claims, 9 Drawing Sheets

(56) References Cited

U.S. PATENT DOCUMENTS

| | | | | |
|---|---|---|---|---|
| 5,912,442 | A * | 6/1999 | Nye et al. | 181/292 |
| 5,965,851 | A * | 10/1999 | Herreman et al. | 181/200 |
| 6,183,837 | B1 * | 2/2001 | Kim | 428/118 |
| 6,512,831 | B1 * | 1/2003 | Herreman et al. | 381/71.3 |
| 6,644,061 | B1 | 11/2003 | Woolfson | |
| 8,201,569 | B2 * | 6/2012 | Goodyear et al. | 134/198 |
| 8,336,672 | B2 * | 12/2012 | Derks et al. | 181/224 |
| 8,418,807 | B1 * | 4/2013 | Nevins et al. | 181/293 |
| 8,570,837 | B2 * | 10/2013 | Toda et al. | 367/176 |
| 8,925,678 | B2 * | 1/2015 | Tizzoni | 181/293 |
| 8,979,014 | B2 * | 3/2015 | Boock et al. | 244/1 N |
| 2002/0036115 | A1 * | 3/2002 | Wilson | 181/292 |
| 2003/0098200 | A1 * | 5/2003 | Clark | 181/292 |
| 2004/0016595 | A1 * | 1/2004 | Andre et al. | 181/290 |
| 2005/0112355 | A1 * | 5/2005 | Wycech | 428/304.4 |
| 2005/0202232 | A1 * | 9/2005 | Sauniere | 428/316.6 |
| 2006/0099380 | A1 * | 5/2006 | Vollmert et al. | 428/92 |
| 2007/0224409 | A1 * | 9/2007 | Dovorany et al. | 428/304.4 |
| 2008/0099278 | A1 * | 5/2008 | Simon et al. | 181/293 |
| 2008/0196266 | A1 | 8/2008 | Jung et al. | |
| 2008/0238274 | A1 * | 10/2008 | Seo et al. | 312/228 |
| 2008/0289664 | A1 * | 11/2008 | Rockwell et al. | 134/42 |
| 2010/0180916 | A1 * | 7/2010 | Colon et al. | 134/18 |
| 2010/0187958 | A1 | 7/2010 | Colon | 312/228 |
| 2010/0307866 | A1 * | 12/2010 | Zickmantel | 181/286 |
| 2011/0168217 | A1 * | 7/2011 | Neff et al. | 134/201 |
| 2011/0290284 | A1 * | 12/2011 | Chung et al. | 134/104.2 |

FOREIGN PATENT DOCUMENTS

| | | | |
|---|---|---|---|
| CN | 102044239 | | 5/2011 |
| CN | 103385676 | A | 11/2013 |
| DE | 42 43 320 | A1 | 6/1994 |
| DE | 44 13 009 | A1 | 10/1995 |
| DE | 10 2008 009 779 | A1 | 8/2008 |
| EP | 0 800 030 | A1 | 10/1997 |
| JP | 62-170296 | | 7/1987 |
| JP | 02-026598 | | 1/1990 |
| JP | 03-025108 | | 2/1991 |
| JP | 2000-279691 | A * | 10/2000 |
| JP | 2001-096090 | A | 4/2001 |
| JP | 2003-108148 | | 4/2003 |
| JP | 3642382 | | 4/2005 |
| KR | 20-2009-0010171 | | 10/2009 |
| WO | WO 2011/021798 | | 2/2011 |

OTHER PUBLICATIONS

Translation of 2000279691 dated Oct. 10, 2000.*

German Office Action dated Dec. 12, 2013 for corresponding Application No. 102013208612.1.

Ukrainian Office Action dated Sep. 10, 2013.

Great Britain Examination Report dated Mar. 18, 2014 issued in Application No. GB 1308519.6.

Zhang Shenshu; Introduction to architectural physics environment; Wuhan University of Technology printed; ISBN 7-5629-2293-4 (Full English Translation).

* cited by examiner

APPLIANCE HAVING NOISE REDUCTION DEVICE

CROSS-REFERENCE TO RELATED APPLICATION(S)

This application claims priority to Korean Patent Application No. 10-2012-0049610, filed in Korea on May 10, 2012, which is hereby incorporated by reference as if fully set forth herein.

BACKGROUND

1. Field

An appliance having a noise reduction device is disclosed herein.

2. Background

As technology has advanced, a variety of appliances have been recently developed to facilitate convenience at home. These appliances may be provided in homes or other spaces.

Such appliances include respective drives therein. For example, appliances, such as vacuum cleaners, dishwashers, washing machines, air conditioners, air cleaners, computers, and projectors, generate all kinds of noise, and thus, noise pollution has increasingly worsened. Accordingly, efforts to block or reduce noise generated from a variety of noise sources in modern life have continued, and strict mandatory regulations against various noise levels have been gradually increased.

Appliances now often include components to suppress or reduce noise or vibration, and in particular, sound absorbing materials are widely used to remove noise. As conventional sound absorbing materials, felt, sponge, polyurethane foam, or similar materials have been mainly used. In addition, a material, in which compression fiber, glass fiber, rock fiber, or regenerated fiber, has been impregnated with thermoplastic resin or thermosetting resin, is representative of a sound absorbing material.

FIG. 1 is a perspective view of a sound absorbing material formed by bonding porous materials. The sound absorbing material 10 of FIG. 1 is formed by bonding a first layer 11 made of a porous yarn, a second layer 12 made of a flame retarding sponge, and a third layer 13 made of polyurethane foam, which sequentially absorb sound to reduce noise.

However, the above-mentioned sound absorbing material 10 has a problem in that a sound absorbing capacity is not sufficient for low frequency noise generated by drives of various appliances. In addition, the existing sound absorbing material 10 mainly uses glass fiber or polyurethane foam, an internal structure of which has a porous form or a complicated sound propagation path, in order to promote exhaustion of sound wave energy. In a case in which the sound absorbing material 10 is glass fiber, it is legally regulated to use the sound absorbing material 10 in terms of environmental pollution due to arsenic acid, and there are disadvantages to using such a material in appliances because of weak durability and moisture resistance.

Moreover, the conventional sound absorbing material 10 requires multilayered sound absorbing materials. Therefore, in using the sound absorbing material 10 within appliances, there are problems in that a large occupation space is required and a whole weight of the appliance increases.

BRIEF DESCRIPTION OF THE DRAWINGS

Embodiments will be described in detail with reference to the following drawings in which like reference numerals refer to like elements, and wherein.

DETAILED DESCRIPTION

Figure 1:
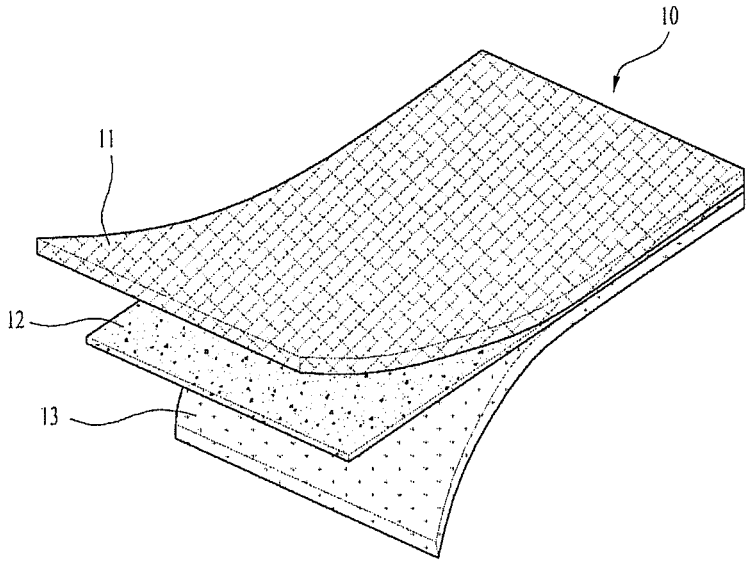
FIG. 1 is a perspective view of a sound absorbing material formed by bonding porous materials.

Reference will now be made in detail to embodiments, examples of which are illustrated in the accompanying drawings. Unless otherwise defined, all terms used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure.

Also, embodiments will be described with respect to the drawing, and it should be understood that numerous other modifications and variations may be devised by those skilled in the art that will fall within the intrinsic aspects of the embodiments. Wherever possible, the same reference numbers will be used throughout the drawings to refer to the same or like parts.

Figure 2:
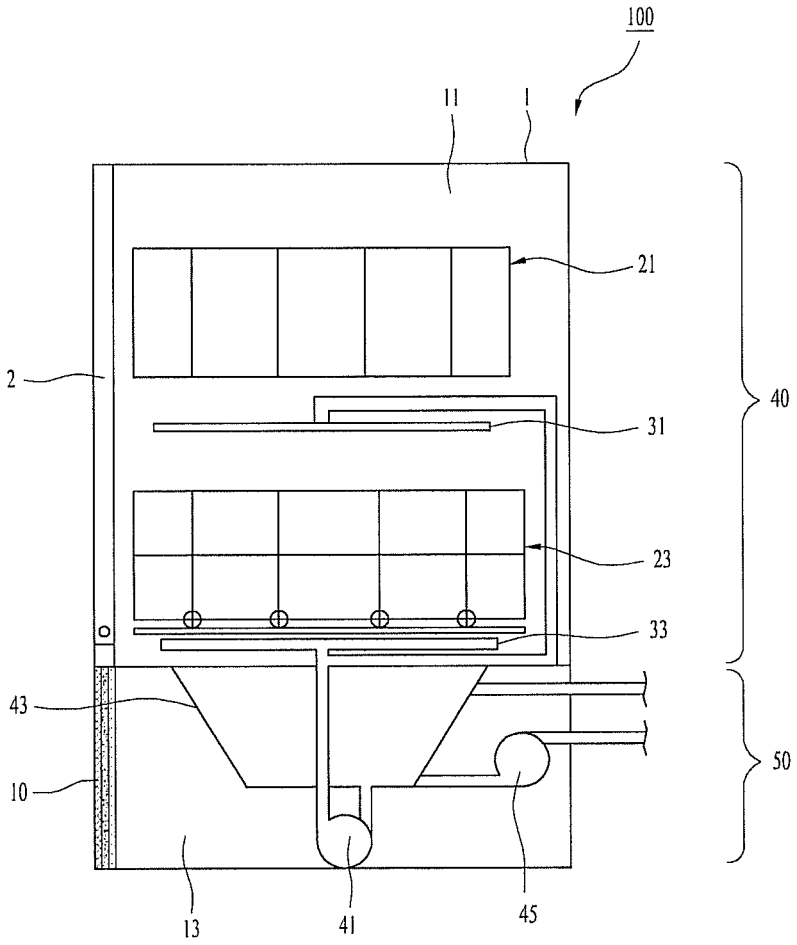
FIG. 2 is a schematic view of an exemplary dishwasher in which a sound absorbing material is mounted.

FIG. 2 is a schematic side cross-sectional of a dishwasher in which a sound absorbing material is mounted. Referring to FIG. 2, sound absorbing material 10 may be mounted near a drive 50 which generates most of noise. Referring to FIG. 2, the dishwasher 100 may include the drive 50 to spray washing water into a tub 11 or discharge the washing water to the outside. The drive 50 may be arranged in a machine room 13 provided at a lower portion of a main body 1. The drive 50 may include a washing pump 41 to supply the washing water to spraying arms 31 and 33 provided in the tub 11 in a washing space 40 of the dishwasher 100. In addition, the drive 50 may include a sump 43 to collect the washing water. Further, the drive 50 may include a drainage pump 45 to discharge the washing water collected in the sump 44 outside the dishwasher.

Most noise is generated by the drive 50, which includes the washing pump 41 and the sump 43, to move the washing water to the spraying arms 31 and 33 so as to spray the washing water onto racks 21 and 23 in the tub 11. Accordingly, as the drive 50 of the dishwasher 100 is provided at a lower portion thereof, the sound absorbing material 10 may be provided in or at a front lower portion of the dishwasher, namely, in or at a front lower side of the main body 1 formed with a door 2. This is because noise generated by an appliance propagates in a direction opposite a wall as a rear of the appliance is generally located near the wall.

In more detail, the sound absorbing material 10 may be arranged in or at the front of the machine room 13 in which the drive 50 is provided. In such a case, the sound absorbing material 10 may be provided in or at a lower portion of the door 2 of the dishwasher 100. Thus, noise generated by the washing pump 41 or the drainage pump 45 may be absorbed by the sound absorbing material 10, so that the noise being transferred outside the dishwasher may be reduced.

A noise reduction device 500 according to embodiments discussed herein may be provided in such an appliance, instead of or in addition to the sound absorbing material 10. The appliance may include a dishwasher, a washing apparatus, a refrigerator, and an air conditioner. The washing apparatus may include, for example, a washing machine, a drying machine, and a washing machine having a drying function.

Figure 3:
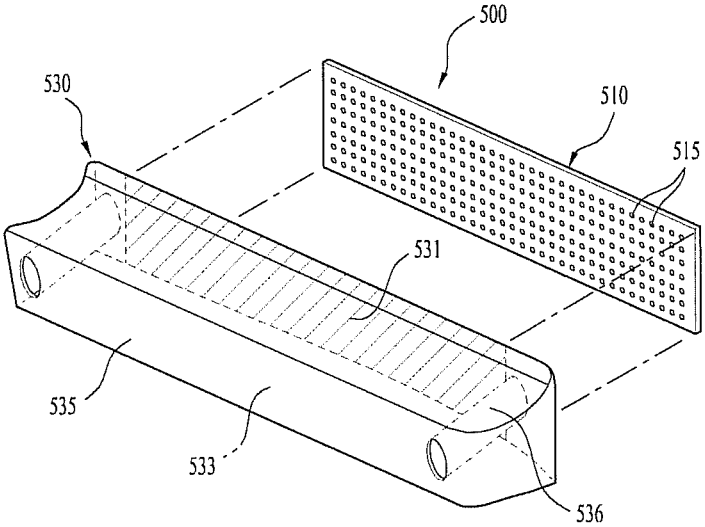
FIG. 3 is an exploded perspective view of a noise reduction device according to embodiments.

FIG. 3 is an exploded perspective view of a noise reduction device according to an embodiment. The noise reduction device 500 may include a sound absorbing plate 510. The sound absorbing plate 510 may have a plurality of sound absorbing holes 515, through which noise generated by the drive provided within an appliance may pass. In addition, the noise reduction device 500 may include a resonance member 530, at least one side of which may have an open side 531 and which is formed therein with a hollow portion 533.

The above-mentioned sound absorbing material 10 realizes a soundproof effect in such a way that energy of a sound wave (a vibrating air particle) generated by a noise source is converted into thermal energy while passing through the multilayered sound absorbing material 10. In contrast, the noise reduction device 500 according to the embodiments performs sound absorption in such a way that air within the resonance member 530 acts as a spring and sound wave energy introduced into the sound absorbing holes 515 is converted into thermal energy by friction in the resonance member 530. This is based on Helmholtz resonance theory. That is, the noise reduction device 500 according to embodiments is relatively light and economical, as there is no need for a multilayered sound absorbing material, like the conventional sound absorbing material 10.

The sound absorbing plate 510 may be airtightly fastened to the open side 531 of the resonance member 530 in order to obtain a noise attenuation effect. The airtight fastening may be realized by various methods, such as, for example, an ultrasonic fusion method, a bonding method, and a bolt fastening method having a seal, depending on a material and a fastening manner. As these methods are obvious, no detailed description thereof will be provided.

The sound absorbing plate 510 may be formed in a plate shape having a predetermined thickness. The sound absorbing plate 510 may be formed in a rectangular shape; however, embodiments are not limited thereto.

The sound absorbing plate 510 may include the plurality of sound absorbing holes 515. The plurality of sound absorbing holes 515 may be formed in the sound absorbing plate 510. In this case, the plurality of sound absorbing holes 515 may be arranged to be spaced apart from each other by a predetermined interval, and may be arranged in the form of a lattice.

In addition, the sound absorbing plate 510 may have a thickness of approximately 0.5 mm to approximately 2 mm. Each of the plurality of sound absorbing holes 515 may have a diameter of approximately 0.05 mm to approximately 1 mm. As drives of appliances have different types of drive members, respectively, a number and diameters of the sound absorbing holes 515 may be modified to be suitable for characteristics of each appliance within numerical values according to a noise frequency generated in or by the appliance.

The sound absorbing holes 515 may be required to have uniform diameters and widths, so that noise generated by the drive and other components may maintain an original frequency during introduction into the resonance member 530. The sound absorbing plate 510 may made of, for example, a plastic material, in consideration of manufacturing costs. However, if the sound absorbing plate 510 is made of a metal material, durability may be increased compared to the sound absorbing plate made of a plastic material. Accordingly, the sound absorbing plate 510 may be realized, taking into account manufacturing costs and characteristics of each appliance.

As show in FIG. 3, the resonance member 530 may include the open side 531, and the hollow portion 533, which may be an empty space disposed therein. The resonance member 530 may have one or more closed surfaces, except for the open side 531. According to one embodiment, the resonance member 530 may have a rectangular shape, and be formed at one surface thereof with the open side 531. An inside of the resonance member 530 may include the hollow portion 533, which is an empty space. Further, one side of the resonance member 530 may include a concave portion, which is discussed herein below.

The sound absorbing plate 510 may be coupled to the open side 531, and the hollow portion 533 may be shielded from the outside by the coupled sound absorbing plate 510. Of course, outdoor air may be introduced into the resonance member 510 through the plurality of sound absorbing holes 515 formed in the sound absorbing plate 510. The sound absorbing plate 510 and the resonance member 530 may be produced as separate parts; however, embodiments are not so limited. For example, the sound absorbing plate 510 and the resonance member 530 may be integrally formed.

An appliance according to embodiments may include the noise reduction device 500. As described above, the appliance may include, for example, a dishwasher, a clothes treating apparatus, a refrigerator, or an air conditioner. The air conditioner may be an air conditioner to cool or heat indoor air.

The appliance may include a cabinet that defines an external appearance, and a drive provided within the cabinet to drive the appliance. The drive may include at least one motor. The motor may be, for example, a pump or a fan. Broadly defined, the drive may be a component that generates noise in the appliance.

The noise reduction device 500 may be provided at one side of the cabinet. In this case, the sound absorbing plate 510 of the noise reduction device 500 may be arranged toward the inside of the cabinet. That is, the sound absorbing plate 510 may not be exposed outside the cabinet, but rather, may be provided inside the cabinet. In addition, the noise reduction device 500 may be coupled or oriented in the cabinet, such that the sound absorbing plate 510 is directed toward the drive of the appliance. It may be possible to more efficiently reduce noise propagation to the outside of the appliance by arranging the sound absorbing plate 510 so that a component, which generates noise of or in the appliance, is directed toward the drive. In addition, the noise reduction device 500 may be mounted in the cabinet. That is, the noise reduction device 500 may be mounted so as not to protrude outside of the cabinet.

According to one embodiment, the noise reduction device 500 may replace one side of the cabinet defining an external appearance of the appliance. That is, the noise reduction device 500 may form a portion of the external appearance of the appliance. Accordingly, an opposite surface of the open side 531, to which the sound absorbing plate 510 may be coupled, may be exposed outside the cabinet. Moreover, an opposite surface to the open side 531 may replace one side of the cabinet and form a portion of the external appearance of the appliance.

According to another embodiment, the noise reduction device 500 may be mounted so as to contact an inner side surface of the cabinet. Accordingly, an opposite surface 535 to the open side 531, to which the sound absorbing plate 510 may be coupled, may be arranged to contact with the inner side surface of the cabinet.

Hereinafter, an embodiment will be described in which the noise reduction device 500 is provided in an appliance, such as a dishwasher, a clothes treating apparatus, a refrigerator, or an air conditioner for both heating and cooling. However, as embodiments disclosed herein are intended to reduce noise generated by the drive of the appliance, a structure of the drive and a position of the noise reduction device 500 according to embodiments in each appliance will be mainly described, rather than specific configurations and operations of the appliances themselves. In addition, the following description is only illustrated by way of example, and it is obvious that the noise reduction device 500 according to embodiments may be applicable to other appliances.

Figure 4:
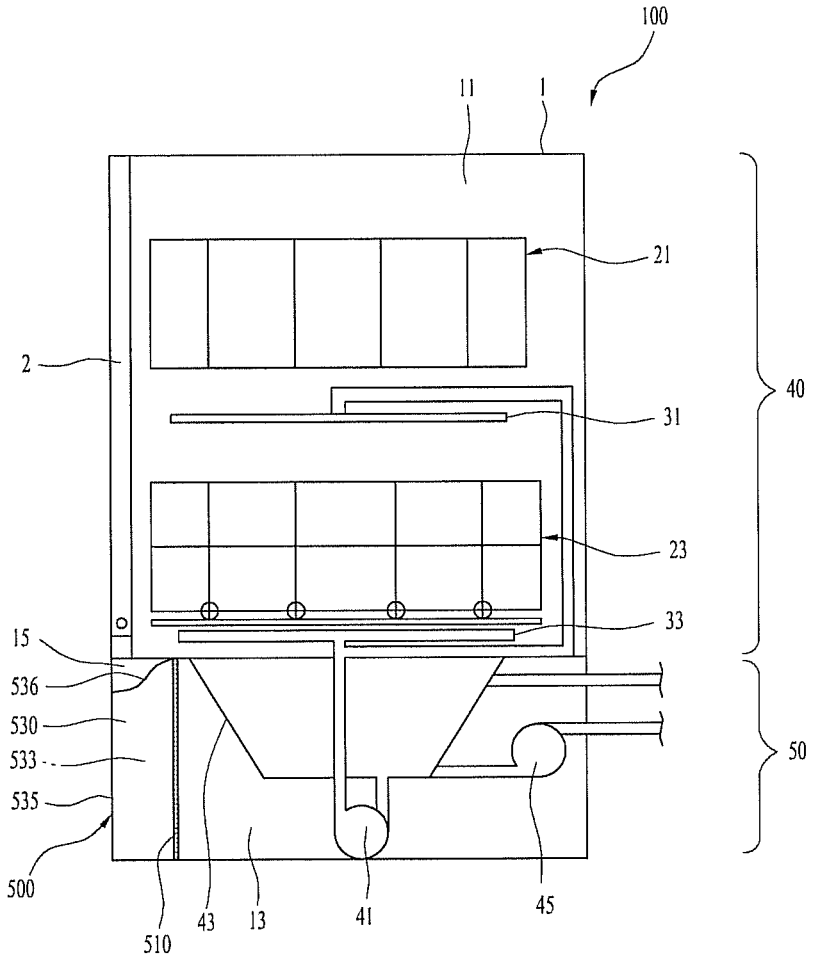
FIG. 4 is a schematic view of an exemplary dishwasher to which a noise reduction device according to embodiments may be mounted.

FIG. 4 is a schematic view of an exemplary dishwasher to which a noise reduction device 500 according to embodiments may be mounted. The dishwasher according to this embodiment shown in FIG. 4 may include the noise reduction device 500 instead of or in addition to the sound absorbing material 10 in comparison to the dishwasher shown in FIG. 2. No detailed description will be given of the same configurations as those of FIG. 2.

The dishwasher 100 may include a cabinet 1, which may define an external appearance thereof and be provided, at one side thereof, with an openable and closable door 2. In addition, the dishwasher 100 may include a tub 11, which may be provided within the cabinet 1 to define a washing object receiving space. Further, the dishwasher 100 may include racks 21 and 23, which may be provided in the tub 11 to fix an object to be washed, and a washing space 40 including spraying arms 31 and 33, which may be respectively, provided at lower portions of the racks 21 and 23 to spray washing water toward the washing object. Moreover, the dishwasher 100 may include a drive 50 to supply the washing water to the spraying arms 31 and 33 or discharge the washing water outside of the dishwasher. The drive 50 may include at least one of a washing water spraying pump 41 or a drainage pump 45, which is described hereinbelow. According to one embodiment, the drive 50 may include the washing water spraying pump 41, which may be provided within the cabinet 1 to supply the washing water into the washing space 40. In addition, the drive 50 may include the drainage pump 45 to discharge the washing water recovered after washing. Further, the drive 50 may include a sump 43, which may receive the supplied or recovered washing water.

The cabinet 1 may be provided, at a lower portion thereof, with a machine room 13 including the drive 50. The machine room 13 may be located in or at a lower space of the cabinet 1, and at least one component of the drive 50 may be mounted within the machine room 13.

The noise reduction device 500 may be arranged at one side of the cabinet 1. The noise reduction device 500 is not limited in the mounting position thereof, but may be provided at a lower side of the cabinet 1.

According to one embodiment, the noise reduction device 500 may be arranged in or at a front portion of the machine room 13. The noise reduction device 500 may be mounted in or at a front of the machine room 13, and may be arranged in or at a lower portion of the door 2 provided in the front portion of the cabinet 1.

In such a case, the sound absorbing plate 510 of the noise reduction device 500 may be disposed toward the inside of the cabinet 1. The sound absorbing plate 510 may be disposed toward or face the drive 50. Accordingly, a first surface 535 of a resonance member 530 facing the sound absorbing plate 510 may be directed outward of the cabinet 1. The first surface 535 of the resonance member 530 facing the sound absorbing plate 510 may replace a portion of the cabinet 1 so as to be exposed to the outside, or may be disposed adjacent to an inner side surface of the cabinet 1. In addition, the noise reduction device 500 may be mounted to contact with the inner side surface of the cabinet 1. That is, the first surface 535 of the resonance member 530 facing or opposite the sound absorbing plate 510 may be arranged to contact with the inner side surface of the cabinet 1.

In one embodiment shown in FIG. 4, the first surface 535 of the resonance member 530 may be arranged so as to be exposed to the outside. A portion of the noise reduction device 500 may be mounted so as to protrude outside of the cabinet 1. However, as shown in FIG. 4, the noise reduction device 500 may be received or contained within the cabinet 1. That is, the noise reduction device 500 may be mounted so as to be inserted or positioned inward or within of the cabinet 1.

In the dishwasher 100, noise sources in the dishwasher 100 are mainly concentrated in the drive 50. More specifically, a typical drive 50 of a dishwasher may be provided at a lower side of the washing space 40, namely, in the lower portion of the cabinet 1 defining the external appearance of the dishwasher.

When taking into account that the dishwasher 100 may be installed to be coupled to a kitchen sink (not shown), the cabinet 1 may be produced so that a concave portion 15 is formed by the concaved side 536 of the resonance member 530 at a lower side of the door 2, in order to provide convenience with respect to a moving path of the door 2.

When taking into account actual use, the drive 50 may be generally arranged in the lower portion of the washing space 40. Therefore, the noise reduction device 500 may be provided outward or inward of the concave portion 15 so that the sound absorbing plate 510 is directed toward a path of noise generated in the drive 50. Although FIG. 4 shows that the noise reduction device 500 is provided outward of the concave portion 15 of the cabinet 1, a fastening position of the noise reduction device 500 according to embodiments is not limited thereto.

As the configuration and structure of the noise reduction device 500 are described above, no detailed description will be given thereof. However, it is obvious that the external appearance of the noise reduction device 500 may be modified within a predictable range, depending on a shape and a volume of the dishwasher 100.

Figure 5:
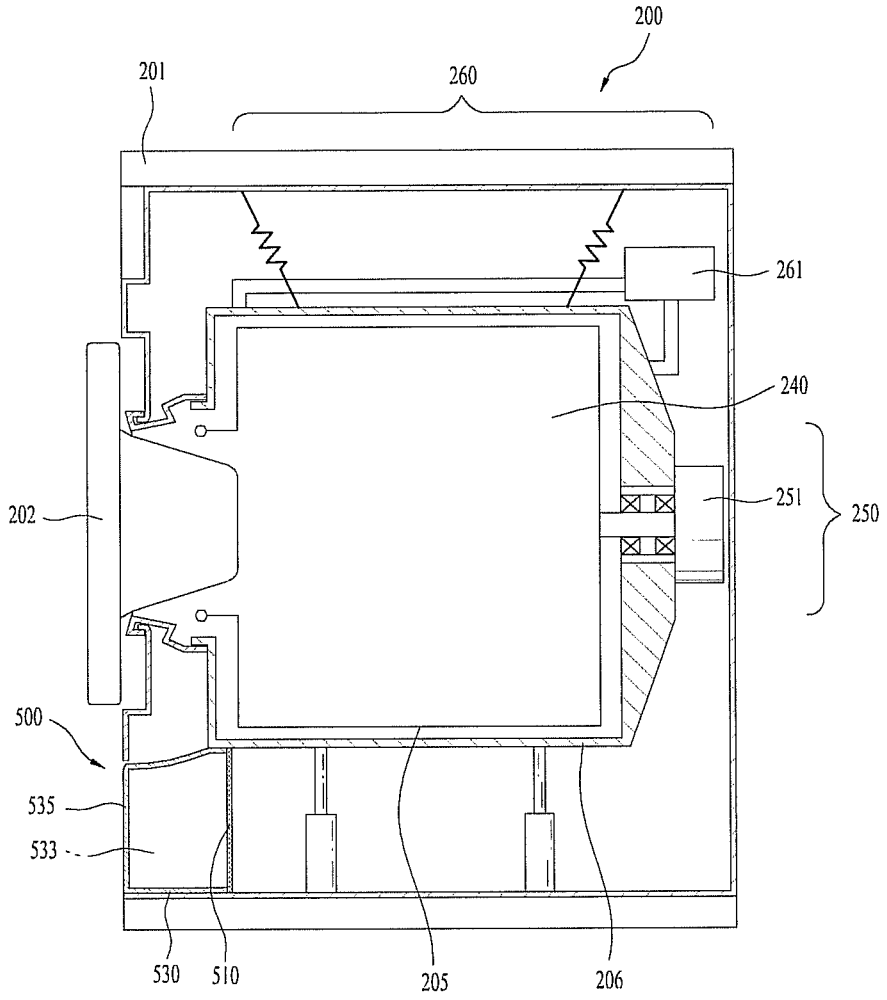
FIG. 5 is a schematic side cross-sectional view of an exemplary clothes treating apparatus to which a noise reduction device according to embodiments may be mounted.

FIG. 5 is a schematic side cross-sectional view of an exemplary clothes treating apparatus to which a noise reduction device according to embodiments may be mounted. The clothes treating apparatus 200 may include a cabinet 201, which may define an external appearance thereof and may be provided, at one side thereof, with an openable and closable door 202, a clothes receiving space 240, which is provided within the cabinet 201 to receive clothes or other items to be washed and/or dried, and drives 250 and 260, which may be provided within the cabinet 201 to wash or dry the clothes received in the clothes receiving space 240. The term "clothes treating apparatus" may refer, for example, to a washing machine which is able to wash clothes, a drying apparatus which is able to dry clothes, or a washing apparatus which is able to simultaneously perform washing and drying. The clothes treating apparatus 200 may be, for example, a front-loading type clothes treating apparatus, in which clothes are put into an opening portion formed in a front of the cabinet, or a top-loading type clothes treating apparatus, in which clothes are put into an opening portion formed in a top of the cabinet. In addition, the clothes treating apparatus may include a refresher to supply hot air to clothes hung on a hanger.

When the clothes treating apparatus 200 having the clothes receiving space 240 is a washing apparatus, the clothes treating apparatus 200 may include a tub 206 to receive washing water, a drum 205 provided within the tub 206 to receive clothes, a first drive 250 to rotate the drum 205, and a second drive 260 to supply hot air for drying the clothes received in the drum 205.

In such a washing apparatus, a drive motor 251 to rotate the drum is a main noise source in the first drive 250, and an air blowing fan 261 having a motor to supply hot air to the drum is a main noise source in the second drive 260. Accordingly, at least one noise reduction device 500 may be provided within the cabinet 201 of the clothes treating apparatus 200, so that the sound absorbing plate 510 is directed toward paths of noise generated in the drives 250, 260.

However, the noise reduction device 500 may be provided at one side of a main body or cabinet 201, so that the sound absorbing plate 510 is directed toward the paths of noise generated in the drives 250 and 260, taking into account characteristics of the washing apparatus in which washing water may flow downwards. More specifically, referring to FIG. 5, the noise reduction device 500 may be provided on at least one of opposite side surfaces, a rear surface, an upper surface, or a front surface. The noise reduction device 500 may be provided at one side of the cabinet 201. The noise reduction device 500 is not limited to a mounting position thereof, but may be provided at a lower side of the cabinet 201 according to one embodiment.

According to one embodiment, the noise reduction device 500 may be provided at a front lower side of the cabinet 201. In such a case, the sound absorbing plate 510 of the noise reduction device 500 may be disposed toward the inside of the cabinet 201. The sound absorbing plate 510 may be disposed toward the drives 250 and 260. Accordingly, a first surface 535 of a resonance member 530 facing the sound absorbing plate 510 may be directed outward of the cabinet 201. The first surface 535 of the resonance member 530 facing the sound absorbing plate 510 may replace a portion of the cabinet 201 so as to be exposed to the outside, or be disposed adjacent to an inner side surface of the cabinet 201. In addition, the noise reduction device 500 may be mounted to contact the inner side surface of the cabinet 201. That is, the first surface 535 of the resonance member 530 facing or opposite the sound absorbing plate 510 may be arranged to contact the inner side surface of the cabinet 201.

In the embodiment shown in FIG. 5, the first surface 535 of the resonance member 530 may be arranged so as to be exposed to the outside. A portion of the noise reduction device 500 may be mounted so as to protrude outside the cabinet 201. However, as shown in FIG. 5, the noise reduction device 500 may be received within the cabinet 201. That is, the noise reduction device 500 may be mounted so as to be inserted inward or contained within of the cabinet 201.

Although FIG. 5 shows that the noise reduction device 500 is provided at the front lower side of the cabinet 201, embodiments are not so limited. That is, the noise reduction device 500 may be provided on or at side surfaces, an upper surface, a rear surface, and/or a base. Moreover, it is obvious that the external appearance of the noise reduction device 500 may be modified within a predictable range, depending on a shape and a volume of the clothes treating apparatus.

Figure 6:
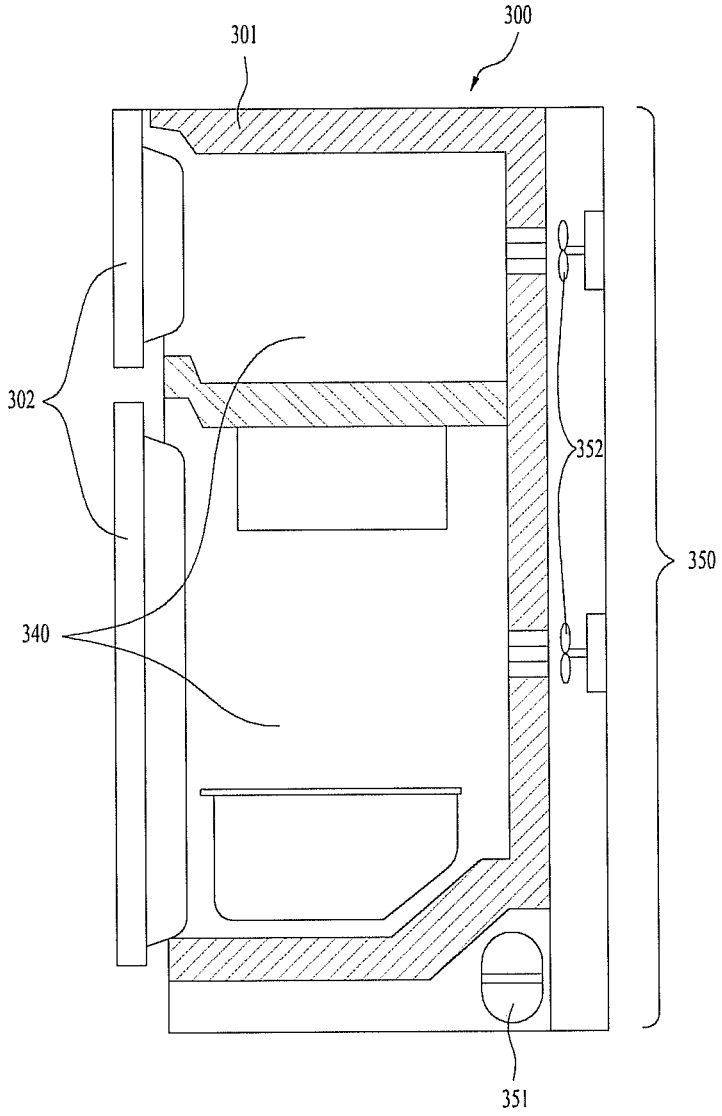
FIG. 6 is a schematic side cross-sectional view of an exemplary refrigerator to which a noise reduction device according to embodiments may be mounted.

FIG. 6 is a schematic side cross-sectional view of an exemplary refrigerator to which a noise reduction device according to embodiments may be mounted. The refrigerator 300 may include a cabinet 301, which may define an external appearance thereof and be provided, at one side thereof, with at least one openable and closable door 302, at least one food receiving space 340, which may be provided within the cabinet 301 to receive food, a cooling device 351, which may be provided to maintain an internal temperature of the food receiving space 340, and a drive 350 including at least one air blowing fan 352. The drive 350 may be disposed at a rear of the refrigerator 300, and may cool air introduced from the at least one food receiving space 340 using latent heat of refrigerant evaporation. The at least one air blowing fan 352 may be disposed adjacent to or on or in a flow path of the cooling device 351, which may include a compressor, a heat radiating plate, and a condenser, so as to circulate heat-exchanged cold air into the at least one food receiving space 340.

In such a refrigerator 300, the cooling device 351 and the at least one air blowing fan 352 are main noise sources. Accordingly, at least one noise reduction device 500 may be provided, for example, at opposite side surfaces, an upper side, or a lower side of a rear of the cabinet 301, so that a sound absorbing plate 510 may be directed toward a path of noise generated in the drive 350.

In such a case, the sound absorbing plate 510 of the noise reduction device 500 may be disposed toward the inside of the cabinet 201. The sound absorbing plate 510 may be disposed toward the drive 350. Accordingly, a first surface 535 of a resonance member 530 facing or opposite the sound absorbing plate 510 may be directed outward of the cabinet 301. The first surface 535 of the resonance member 530 facing or opposite the sound absorbing plate 510 may replace a portion of the cabinet 301 so as to be exposed to the outside, or be disposed adjacent to an inner side surface of the cabinet 301. In addition, the noise reduction device 500 may be mounted to contact an inner side surface of the cabinet 301. That is, the first surface 535 of the resonance member 530 facing or opposite the sound absorbing plate 510 may be arranged to contact the inner side surface of the cabinet 301.

Although not shown in the drawings, in one embodiment, the first surface 535 of the resonance member 530 may be arranged so as to be exposed to the outside. A portion of the noise reduction device 500 may be mounted so as to protrude outside of the cabinet 301. However, as shown in FIG. 4, the noise reduction device 500 may be received within the cabinet 301. That is, the noise reduction device 500 may be mounted so as to be inserted inward of and contained within the cabinet 301.

As the configuration and structure of the noise reduction device 500 are described above, no detailed description will be given thereof. However, it is obvious that the external appearance of the noise reduction device 500 may be modified within a predictable range, depending on a shape and a volume of the refrigerator 300.

Figure 7:
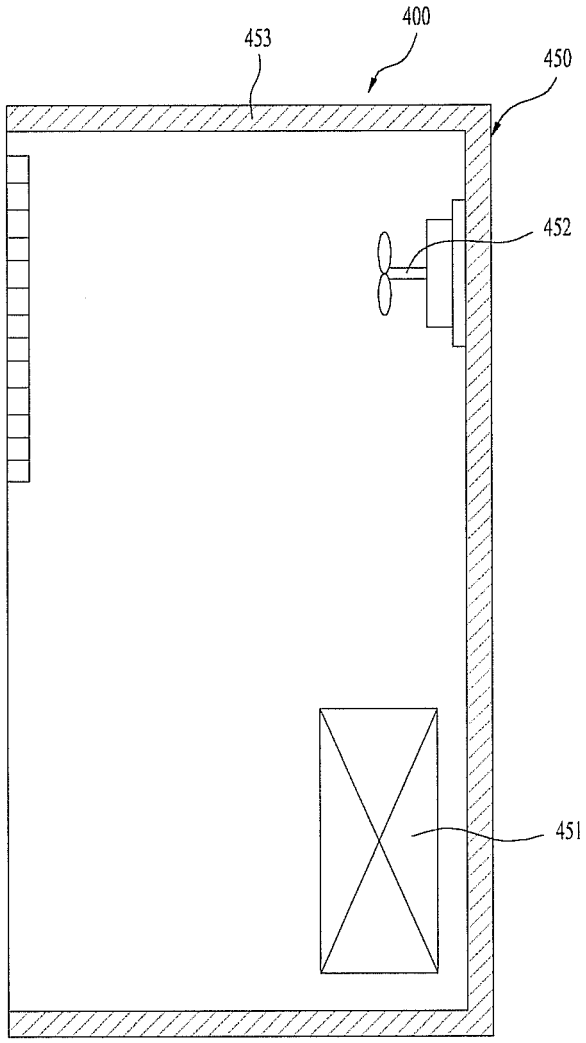
FIG. 7 is a schematic side cross-sectional view of an exemplary air conditioning apparatus to which a noise reduction device according to embodiments may be mounted.
Figure 8:
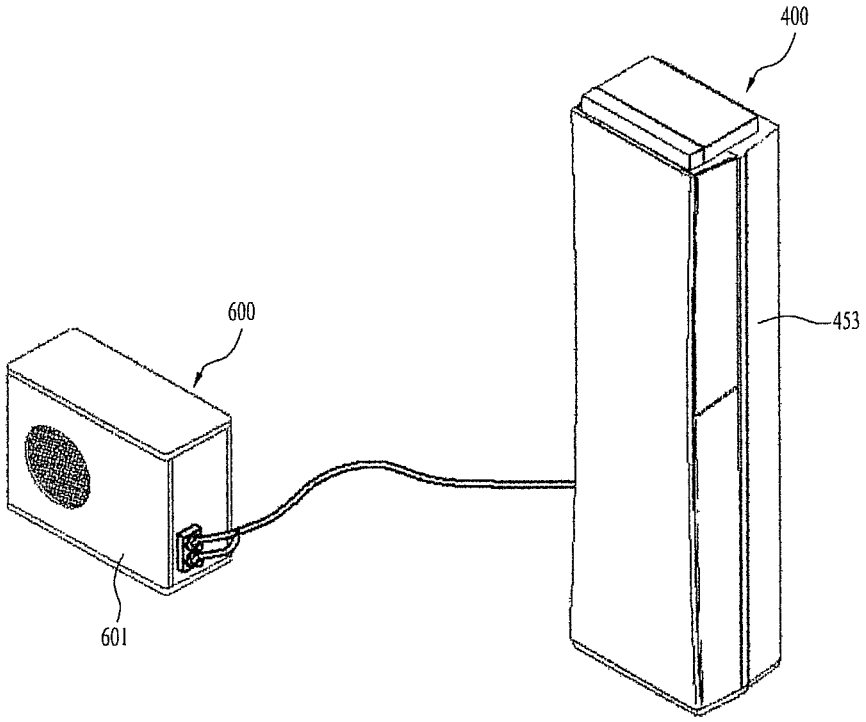
FIG. 8 is a perspective view of the exemplary air conditioning apparatus of FIG. 7.
Figure 9:
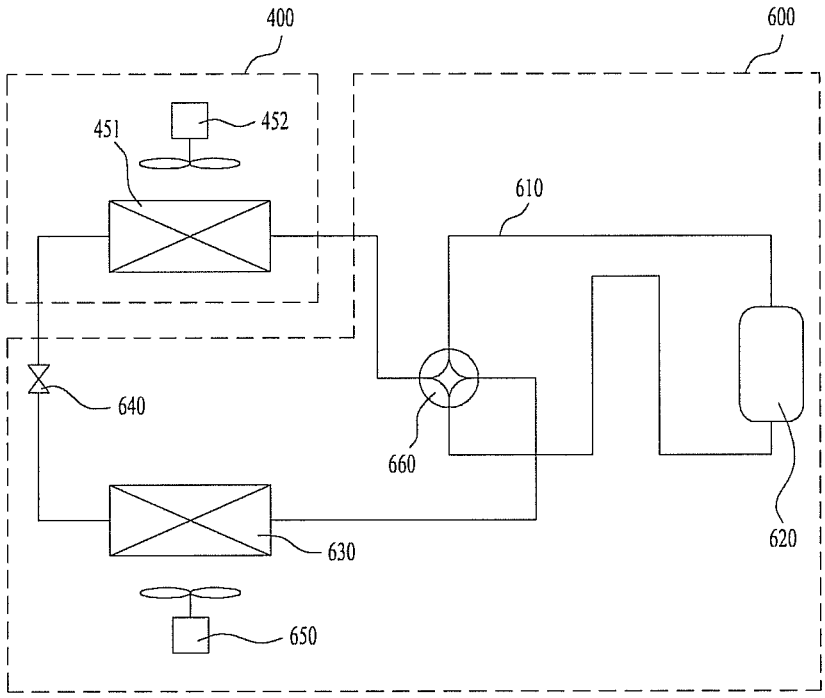
FIG. 9 is a block diagram of the air conditioning apparatus of FIG. 8.

FIG. 7 is a side cross-sectional view of an exemplary air conditioner for both heating and cooling to which a noise reduction device according to embodiments may be mounted, FIG. 8 is a perspective view of the exemplary air conditioning apparatus of FIG. 7, and FIG. 9 is a block diagram of the air conditioning apparatus of FIG. 8. The air conditioner for both heating and cooling 400 may include an outdoor device 600 including a compressor 620 to compress a refrigerant, a four-way valve 660 to adjust a circulation path 610 of the refrigerant discharged from the compressor 620, an outdoor heat exchanger 630, which may be supplied with the refrigerant compressed by the compressor 620 and exchange heat with outdoor air, and an outdoor fan 650 to forcibly blow air to the outdoor heat exchanger 630, an indoor device 450 including an indoor heat exchanger 451 which heat exchanges with introduced indoor air, and an indoor fan 452 which allows indoor air to be discharged to the outside again after the indoor air introduced from the outside passes through the indoor heat exchanger 451, and a decompression device 640 interposed between one side of the indoor heat exchanger 451 and one side of the outdoor heat exchanger 630. The indoor device 450 may include a cabinet 453, and the indoor heat exchanger 451 and the indoor fan 452 may be provided within the cabinet 453. In such a case, a drive of the indoor device 450 may include at least one of the indoor heat exchanger 451 or the indoor fan 452. Similar to the indoor device, the outdoor device 600 may include a cabinet 601, and the outdoor heat exchanger 630 and the outdoor fan 650 may be provided within the cabinet 601. In such a case, a drive of the outdoor device 600 may include at least one of the outdoor heat exchanger 630 or the outdoor fan 650.

The noise reduction device 500 may be provided at or in either the outdoor device 600 or the indoor device 450. However, in the indoor device 450, the noise reduction device 500 may be provided so that a sound absorbing plate 510 is directed toward a path of noise generated in the indoor device. More specifically, at least one noise reduction device 500 may be provided at or adjacent to or facing the indoor fan 452, which is a main noise source, or one side of the indoor device 450 including the indoor heat exchanger 451, which may be configured by a compressor, and a condenser. That is, the noise reduction device 500 may be provided in at least one of the cabinets of the indoor device or the outdoor device.

In such a case, the sound absorbing plate 510 of the noise reduction device 500 may be disposed toward the inside of the cabinet 453. The sound absorbing plate 510 may be disposed toward the drive of the indoor device or outdoor device. Accordingly, a first surface 535 of a resonance member 530 facing or opposite the sound absorbing plate 510 may be directed outward of the cabinet 453. The first surface 535 of the resonance member 530 facing or opposite the sound absorbing plate 510 may replace a portion of the cabinet 453 so as to be exposed to the outside, or may be disposed adjacent to an inner side surface of the cabinet 453. In addition, the noise reduction device 500 may be mounted to contact the inner side surface of the cabinet 453. That is, the first surface 535 of the resonance member 530 facing or opposite the sound absorbing plate 510 may be arranged to contact the inner side surface of the cabinet 453.

Although not shown in the drawings, in one embodiment, the first surface 535 of the resonance member 530 may be arranged so as to be exposed to the outside. A portion of the noise reduction device 500 may be mounted so as to protrude outside of the cabinet 453. However, the noise reduction device 500 may be received within the cabinet 453. That is, the noise reduction device 500 may be mounted so as to be inserted inward of and contained within the cabinet 453.

As the configuration and structure of the noise reduction device 500 are described above, no detailed description will be given thereof. However, it is obvious that the external appearance of the noise reduction device 500 may be modified within a predictable range, depending on a shape and a volume of the air conditioning apparatus for both heating and cooling 400.

As described above, in accordance with embodiments disclosed herein, it may be possible to enhance a soundproof effect by reducing noise, particularly low frequency noise generated by an appliance to a maximum degree. In addition, it may be possible to achieve an increase in internal capacity, a decrease in weight, and a reduction in manufacturing costs in the appliance by providing a noise reduction device having a relatively simple structure.

Embodiments disclosed herein provide an appliance having a noise reduction device that substantially obviates one or more problems due to limitations and disadvantages of the related art.

Embodiments disclosed herein provide an appliance having a noise reduction device capable of efficiently removing noise generated by the appliance.

Embodiments disclosed herein provide an appliance that requires a small occupation space and has a light noise reduction device compared to existing sound absorbing materials.

Embodiments disclosed herein provide a noise reduction device that may include a sound absorbing plate which may have a plurality of sound absorbing holes and a resonance member, one side of which may have an opening portion while being formed therein with a hollow portion so that noise generated by a drive unit or drive of the appliance passes through the noise reduction device, thereby reducing noise generated within a main body of the appliance. The sound absorbing plate may be coupled to the at least one side of the resonance member.

The sound absorbing plate may have a rectangular shape.

The at least one side of the resonance member may include a concaved portion.

The resonance member and the sound absorbing member are integrally formed.

The sound absorbing plate may be formed of plastic or a metal material.

The noise reduction device may be provided within the main body so that the sound absorbing plate is directed toward a noise path generated in the drive unit.

The sound absorbing plate may be air-tightly fastened to the opening portion of the resonance member.

The sound absorbing plate may have a thickness of approximately 0.5 mm to approximately 2 mm. Each of the sound absorbing holes may have a diameter of approximately 0.05 mm to approximately 1 mm.

Embodiments disclosed herein provide a dishwasher that may include a cabinet that defines an external appearance thereof, a tub which may be provided within the cabinet to define a washing object receiving space, a rack which may be provided in the tub to fix a washing object, a spraying arm which may be provided at a lower portion of the rack to spray washing water toward the washing object, a sump that receives the washing water supplied to the spraying arm, a drive unit or drive including a washing water spraying pump which may be provided within the cabinet to supply the washing water to the spraying arm and a drainage pump to discharge the washing water recovered after washing, and a noise reduction device including a sound absorbing plate which may have a plurality of sound absorbing holes and a resonance member, one side of which may have an opening portion while being formed therein with a hollow portion so that noise generated by the drive unit passes through the noise reduction device, to thereby reduce noise generated within a main body. A concave portion may be formed at a lower side of the door, and the noise reduction device may be provided in the concave portion so that the sound absorbing plate is directed toward a noise path generated in the drive unit.

Embodiments disclosed herein provide a clothes treating apparatus that may include a cabinet which defines an external appearance thereof and may be provided, at one side thereof, with an openable and closable door, a clothes receiving space which may be provided within the cabinet to receive clothes, a drive unit or drive which may be provided within the cabinet to wash or dry the clothes received in the clothes receiving space, and a noise reduction device including a sound absorbing plate which may have a plurality of sound absorbing holes and a resonance member, one side of which may have an opening portion while being formed therein with a hollow portion so that noise generated by the drive unit passes through the noise reduction device, to thereby reduce noise generated within a main body.

Embodiments disclosed herein provide a refrigerator that may include a cabinet that defines an external appearance thereof and may be provided, at one side thereof, with an openable and closable door, a food receiving space which may be provided within the cabinet to receive food, a drive unit or drive which may be provided within the cabinet to keep an internal temperature of the food receiving space, and a noise reduction device including a sound absorbing plate which may have a plurality of sound absorbing holes and a resonance member, one side of which may have an opening portion while being formed therein with a hollow portion so that noise generated by the drive unit passes through the noise reduction device, to thereby reduce noise generated within a main body.

Embodiments disclosed herein provide an air conditioning apparatus that may include an outdoor unit or device including a compressor to compress a refrigerant, a four-way valve to adjust a circulation path of the refrigerant discharged from the compressor, an outdoor heat exchanger which may be supplied with the refrigerant compressed by the compressor and exchange heat with outdoor air, and an outdoor fan to forcibly blow air to the outdoor heat exchanger, an indoor unit or device including an indoor heat exchanger which allows heat exchange to be performed after indoor air is introduced and an indoor fan which allows indoor air to be discharged to the outside again after the indoor air is introduced from the outside and passes through the indoor heat exchanger, a decompression device which may be interposed between one side of the indoor heat exchanger and one side of the outdoor heat exchanger, and a noise reduction device including a sound absorbing plate which may have a plurality of sound absorbing holes and a resonance member, one side of which may have an opening portion while being formed therein with a hollow portion, to thereby reduce noise generated within the indoor unit or the outdoor unit.

Embodiments disclosed herein provide an appliance that may include includes a cabinet that defines an external appearance thereof, a drive unit or drive which may be provided within the cabinet to drive the appliance, and a noise reduction device to reduce noise generated by the drive unit. The noise reduction device may include a resonance member, one side of which may have an opening portion while being formed therein with a hollow portion, and a sound absorbing plate which may have coupled to the opening portion and may have a plurality of sound absorbing holes. The noise reduction device may be provided at one side of the cabinet. The noise reduction device may be mounted to be inserted into the cabinet.

The noise reduction device may replace a portion of the cabinet, and one surface of the resonance member may be exposed to the outside. Also, the noise reduction device may be mounted to come into contact with an inner side surface of the cabinet.

The sound absorbing plate of the noise reduction device may be disposed inward of the cabinet. The sound absorbing plate may be airtightly fastened to the opening portion of the resonance member.

The sound absorbing plate may have a thickness of approximately 0.5 mm to approximately 2 mm. Each of the sound absorbing holes may have a diameter of approximately 0.05 mm to approximately 1 mm.

The appliance according to embodiments may be a dishwasher including a tub which may be provided within the cabinet to define a washing object receiving space, a rack which may be provided in the tub to fix a washing object, a spraying arm which may be provided at a lower portion of the rack to spray washing water toward the washing object, and a sump which may receive the washing water supplied to the spraying arm, and the drive unit or drive may include at least one of a washing water spraying pump which may be provided within the cabinet to supply the washing water to the spraying arm, or a drainage pump to discharge the washing water recovered after washing. The appliance may further include a door which may be provided in the cabinet to open and close the washing object receiving space, and the noise reduction device may be provided in a concave portion formed at a lower side of the door.

The appliance according to embodiments may be a clothes treating apparatus including a clothes receiving space which may be provided within the cabinet to receive clothes, and a door to open and close the clothes receiving space. The clothes receiving space may be configured by a drum, and the drive unit or drive may include a drive motor to rotate the drum. The drive unit may further include an air blowing fan to supply hot air into the clothes receiving space.

The appliance according to embodiments may be a refrigerator including a food receiving space which may be provided within the cabinet to receive food, and the drive unit or drive may include at least one of a cooling unit or device to keep an internal temperature of the food receiving space and an air blowing fan to supply heat-exchanged cold air into the food receiving space.

The appliance according to embodiments may be an air conditioning apparatus including an outdoor unit or device including a compressor to compress a refrigerant, a four-way valve to adjust a circulation path of the refrigerant discharged from the compressor, an outdoor heat exchanger which may be supplied with the refrigerant compressed by the compressor and exchange heat with outdoor air, and an outdoor fan to forcibly blow air to the outdoor heat exchanger, an indoor unit or device including an indoor heat exchanger which allows heat exchange to be performed after indoor air may be introduced, and an indoor fan which allows the indoor air to be discharged to the outside again after the indoor air is introduced from the outside and passes through the indoor heat exchanger, and a decompression device which may be interposed between one side of the indoor heat exchanger and one side of the outdoor heat exchanger, and the drive unit may include at least one of the outdoor heat exchanger, the outdoor fan, the indoor heat exchanger, or the indoor fan.

It will be apparent to those skilled in the art that various modifications and variations can be made without departing from the spirit or scope. Thus, it is intended that embodiments cover modifications and variations provided they come within the scope of the appended claims and their equivalents.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An appliance, comprising:

a cabinet that defines an external appearance thereof;

a drive provided within the cabinet to drive the appliance; and a noise reduction device to reduce noise generated by the drive, wherein the noise reduction device includes:

a resonance member, at least one side of which is an open and including a hollow portion formed therein, wherein the resonance member has one or more closed surfaces except for the at least one open side; and a sound absorbing plate coupled to the at least one open side, the sound absorbing plate having a plurality of sound absorbing holes, wherein the sound absorbing plate is directed toward the drive of the appliance.

2. The appliance according to claim 1, wherein the noise reduction device is provided at one side of the cabinet.

3. The appliance according to claim 1, wherein the noise reduction device is mounted fully within the cabinet.

4. The appliance according to claim 1, wherein the noise reduction device replaces a portion of the cabinet, and one surface of the resonance member is exposed to the outside of the cabinet.

5. The appliance according to claim 1, wherein the noise reduction device is mounted to contact an inner side surface of the cabinet.

6. The appliance according to claim 1, wherein the sound absorbing plate is disposed inward of the cabinet.

7. The appliance according to claim 1, wherein the sound absorbing plate is fastened to the at least one open side of the resonance member.

8. The appliance according to claim 1, wherein the sound absorbing plate has a thickness of approximately 0.5 mm to approximately 2 mm.

9. The appliance according to claim 1, wherein each of the plurality of sound absorbing holes has a diameter of approximately 0.05 mm to approximately 1 mm.

10. The appliance according to claim 1, wherein the resonance member has a rectangular shape.

11. The appliance according to claim 1, wherein at least one side of the resonance member includes a concaved portion.

12. The appliance according to claim 1, wherein the resonance member and the sound absorbing member are integrally formed.

13. The appliance according to claim 1, further including:

a tub provided within the cabinet to define an object receiving space;

a rack provided in the tub to fix an object;

a spraying arm provided at a lower portion of the rack to spray washing water toward the object; and a sump that receives the washing water supplied to the spraying arm, wherein the drive includes at least one of a washing water spraying pump provided within the cabinet to supply the washing water to the spraying arm, and a drainage pump to discharge the washing water recovered after washing.

14. The appliance according to claim 13, further including:

a door provided in the cabinet to open and close the object receiving space, wherein the noise reduction device is provided in a concave portion formed at a lower side of the door.

* * * * *